US009089943B2

(12) United States Patent
Lipson

(10) Patent No.: US 9,089,943 B2
(45) Date of Patent: Jul. 28, 2015

(54) COMPOSITE PADS FOR BUFFING AND POLISHING PAINTED VEHICLE BODY SURFACES AND OTHER APPLICATIONS

(76) Inventor: Ronald Lipson, Orchard Lake, MI (US)

( * ) Notice: Subject to any disclaimer, the term of this patent is extended or adjusted under 35 U.S.C. 154(b) by 867 days.

(21) Appl. No.: 13/017,673

(22) Filed: Jan. 31, 2011

(65) Prior Publication Data

US 2011/0189927 A1 Aug. 4, 2011

Related U.S. Application Data

(60) Provisional application No. 61/299,596, filed on Jan. 29, 2010.

(51) Int. Cl.

| | |
|---|---|
| ***B24D 7/14*** | (2006.01) |
| ***B24B 1/00*** | (2006.01) |
| ***B24D 7/18*** | (2006.01) |
| ***B24B 29/00*** | (2006.01) |

(52) U.S. Cl.

CPC . *B24B 1/00* (2013.01); *B24B 29/00* (2013.01); *B24D 7/14* (2013.01); *B24D 7/18* (2013.01)

(58) Field of Classification Search

CPC ..... B24B 1/00; B24B 29/00; B24D 7/14; B24D 7/18; B24D 13/147

USPC ..... 15/230; 451/65, 66, 461, 527, 528, 529, 451/539, 548

See application file for complete search history.

(56) References Cited

U.S. PATENT DOCUMENTS

| | | | | |
|---|---|---|---|---|
| 2,309,016 | A * | 1/1943 | Ryan | 451/548 |
| 2,451,295 | A * | 10/1948 | Metzger et al. | 451/548 |
| 2,496,352 | A * | 2/1950 | Metzger et al. | 451/548 |
| 3,299,579 | A * | 1/1967 | Jacobson | 451/266 |
| 5,167,096 | A * | 12/1992 | Eltoukhy et al. | 451/59 |
| 5,389,032 | A * | 2/1995 | Beardsley | 451/359 |
| 5,503,592 | A * | 4/1996 | Neumann | 451/278 |
| 5,534,106 | A * | 7/1996 | Cote et al. | 438/693 |
| 5,951,380 | A * | 9/1999 | Kim | 451/65 |
| 6,168,508 | B1 * | 1/2001 | Nagahara et al. | 451/527 |
| 6,197,692 | B1 * | 3/2001 | Fushimi | 438/692 |
| 6,261,164 | B1 * | 7/2001 | Rivard et al. | 451/359 |
| 6,309,282 | B1 * | 10/2001 | Wright et al. | 451/41 |
| 6,572,700 | B2 | 6/2003 | Kawase et al. | |
| 7,604,530 | B2 | 10/2009 | Shih | |
| 2003/0190875 | A1 * | 10/2003 | Grabbe | 451/65 |
| 2009/0191800 | A1 * | 7/2009 | Rivard et al. | 451/466 |

* cited by examiner

*Primary Examiner* — Timothy V Eley

(74) *Attorney, Agent, or Firm* — Gifford, Krass, Sprinkle, Anderson & Citkowski, P.C.

(57) ABSTRACT

A composite pad includes an outer pad portion having a surface with a firmness, stiffness or abrasiveness, and an inner pad portion disposed on or in the outer pad portion, the inner pad portion having a surface with a firmness, stiffness or abrasiveness which is greater than that of the outer pad surface. The backside of the composite pad preferably includes a hook-and-loop or other mechanism for attachment to a tool such as an orbital polisher. The inner portion may used to remove larger scratches left from sand paper (or other abrasives) then, without removing the pad, the polisher tool may be tilted relative to the surface enabling the outer portion to buff the area and remove any swirl marks. The surface of the inner pad may be raised relative to the surface of the outer pad, flush or recessed. In the preferred embodiments the various pad portions are made of foam material such as polyurethane.

6 Claims, 2 Drawing Sheets

COMPOSITE PADS FOR BUFFING AND POLISHING PAINTED VEHICLE BODY SURFACES AND OTHER APPLICATIONS

REFERENCE TO RELATED APPLICATION

This application claims priority from U.S. Provisional Patent Application Ser. No. 61/299,596, filed Jan. 29, 2010, the entire content of which is incorporated herein by reference.

FIELD OF THE INVENTION

This invention relates generally to painted surface preparation and, in particular to composite pads that may be used for different types of surface treatments without changing out the pad from an electric tool.

BACKGROUND OF THE INVENTION

All OEM vehicles have small surface paint defects typically caused by dirt. The defects are removed by a finessing process. A worker typically uses a small (i.e., 1") sanding disc with approximately #3000 grit. After the defect is sanded out, the surface is then polished with a liquid applied to a foam pad mounted on an orbital polisher rotating at about 3000 RPM. Within a few seconds, the sand scratches are buffed out and ideally one cannot see where the defect used to be.

With the advent of newer paint technology, however, came different surface characteristics in the paint. Many of these new paints require defect (i.e., scratch sanding) removal using a stiffer foam pad, followed by the use of a softer or less stiff foam pad that leaves the repaired area clean and properly finished. This process constitutes a two-step polishing system and process, consuming time and materials.

Commercially available foam pads come in different diameters such as 3", 4" and larger, with attachment mechanisms such as hook-and-loop backing material. Different types of foams are typically provided in different colors so they are easily recognized by an operator. For example, some coarse "cutting" foam pads are cyan, polishing pads may be orange, and foam pads for finishing may be red.

SUMMARY OF THE INVENTION

This invention resides in a composite pad useful in removing defects from painted surfaces including auto bodies. The preferred embodiment includes an outer pad portion having a surface with a stiffness, firmness, abrasiveness, or density, and an inner pad portion disposed on or in the outer pad portion, the inner pad portion having a surface with a stiffness, firmness, abrasiveness, or density which is different than that of the outer pad surface. The backside of the pad includes a hook-and-loop or other mechanism for attachment to a tool such as an orbital polisher.

In preferred embodiments, the exposed surface of the inner pad portion is firmer, stiffer or more abrasive than the exposed surface of the outer pad portion. One advantage of the invention is that the stiffer inner portion may used to remove larger scratches left from sand paper (or other abrasives) then, without removing the composite pad, the polisher tool may be tilted relative to the surface enabling the outer, softer or less abrasive foam to buff the area and remove swirl marks.

The surface of the inner pad may be raised relative to the surface of the outer pad, flush or recessed. In the preferred embodiments the various pad portions are made of foam material such as polyurethane, though the invention is not limited in this regard in that other synthetic or natural materials may be used including wool and wool blends.

DETAILED DESCRIPTION OF THE INVENTION

Figure 1:
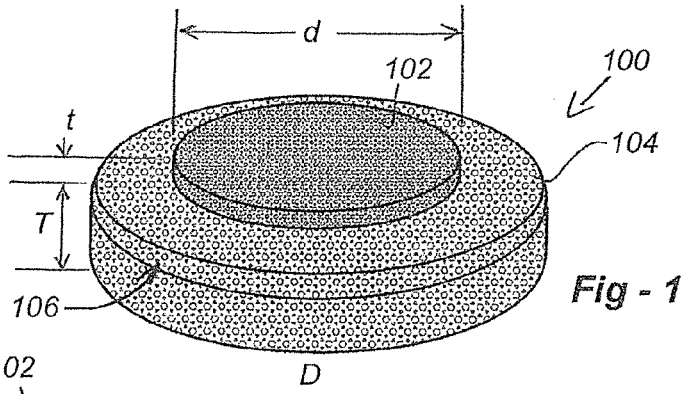
FIG. 1 is an oblique perspective view of a preferred embodiment of the invention.

This invention resides in foam pads used to remove surface defects in painted surfaces, particularly auto bodies. Unique to the invention is the provision of (at least) two different types of foam on a single pad. FIG. 1 is an oblique perspective view of a preferred embodiment of the invention. An inventive pad, depicted generally at 100, includes an outer peripheral pad portion 104 surrounding an inner pad portion 102.

Figure 7:
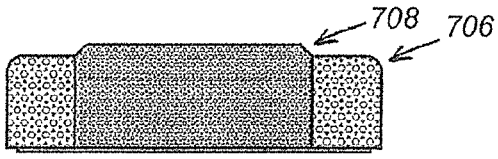
FIG. 7 depicts a raised inner portion having a chamfered peripheral edge.

In the preferred embodiments, the two pad portions are circular and concentric, and the surface of the inner portion 102 is raised relative to the surface of the outer portion 104. The upper edge of the outer pad may include a chamfer at 106 which may be flat or curved as shown at 706 in FIG. 7. If the inner pad portion is raised the outer edge of that portion may be chamfered as well, as depicted at 708 in FIG. 7.

Figure 2:
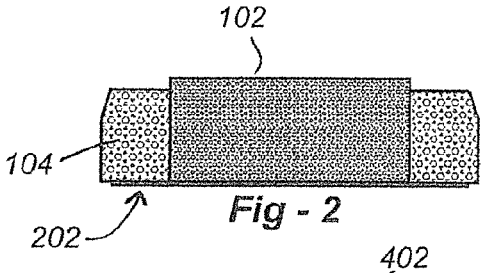
FIG. 2 is a cross-sectional view of the embodiment of FIG. 1.
Figure 5:
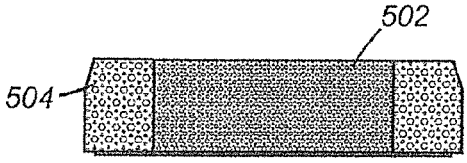
FIG. 5 is a drawing that shows an alternative embodiment of the invention wherein the surface of the inner portion of the pad and the surface of the peripheral portion of the pad are flush with one another.
Figure 6:
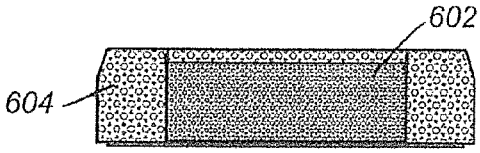
FIG. 6 is a drawing that shows an alternative embodiment of the invention wherein the surface of the inner portion of the pad is recessed relative to the surface of the peripheral portion of the pad.

Continuing the reference to FIGS. 1 and 2, the diameter "D" of the outer pad portion has a diameter configured for attachment to a standard electric tool, for example by way of a hook-and-loop backing 202. A threaded socket, or peripheral elastic gathering (not shown), may alternatively be used for attachment purposes. For example the diameter "D" of the outer pad portion may be 3, 4, 5, or 6 inches or greater, or fractions thereof. The diameter "d" of the inner pad portion may be 1, 2, 3, 4, or 5 inches, or greater, or fractions thereof depending upon D. The thickness "T" of the outer portion 102 may be in the range of ½ to 2 inches, more or less, and the surface of the inner pad portion may be flush with the surface of the outer portion 104 (FIG. 5), or may be raised or recessed (FIG. 6) by 1/16 to 1/2 inch or more depending upon the characteristics of the inner and outer pad portions and the application at hand.

Figure 4:
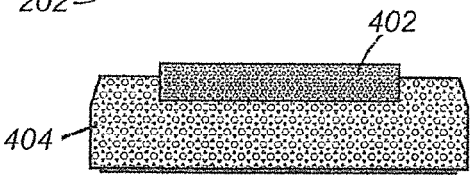
FIG. 4 is a drawing that shows an alternative embodiment of the invention wherein the inner portion of the pad does not extent through the outer pad portion.

FIG. 2 is a cross section of the pad of FIG. 1. In this embodiment the inner pad portion 102 extends all the way through the outer portion 104 to the backing material 202. As shown in FIG. 4, however, the inner portion 402 may be nested in a cavity in the outer portion 404.

In the preferred embodiments, the inner pad portion is firmer or stiffer, or has a higher load-bearing capacity as compared to the outer pad portion. Such differences can be measured by Indentation Force Deflection (IFD) or Compression Force Deflection (CFD) tests known in the industry. The inner foam may also be less, the same, or more dense than the outer foam, with the idea being that the inner pad can be used to perform initial buffing or polishing, and the outer pad portion being used for final or subsequent buffing or polishing, without having to change the composite pad from the tool to perform the two operations as with existing solutions.

Figure 3A:
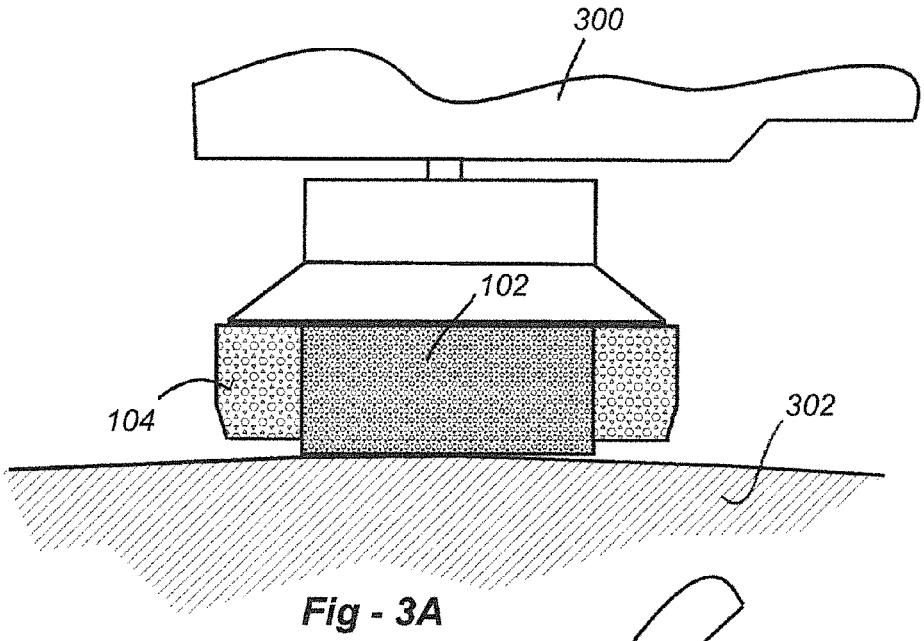
FIG. 3A shows the pad of FIGS. 1 and 2 mounted on an electric tool with the inner portion of the pad being used for surface treatment.
Figure 3B:
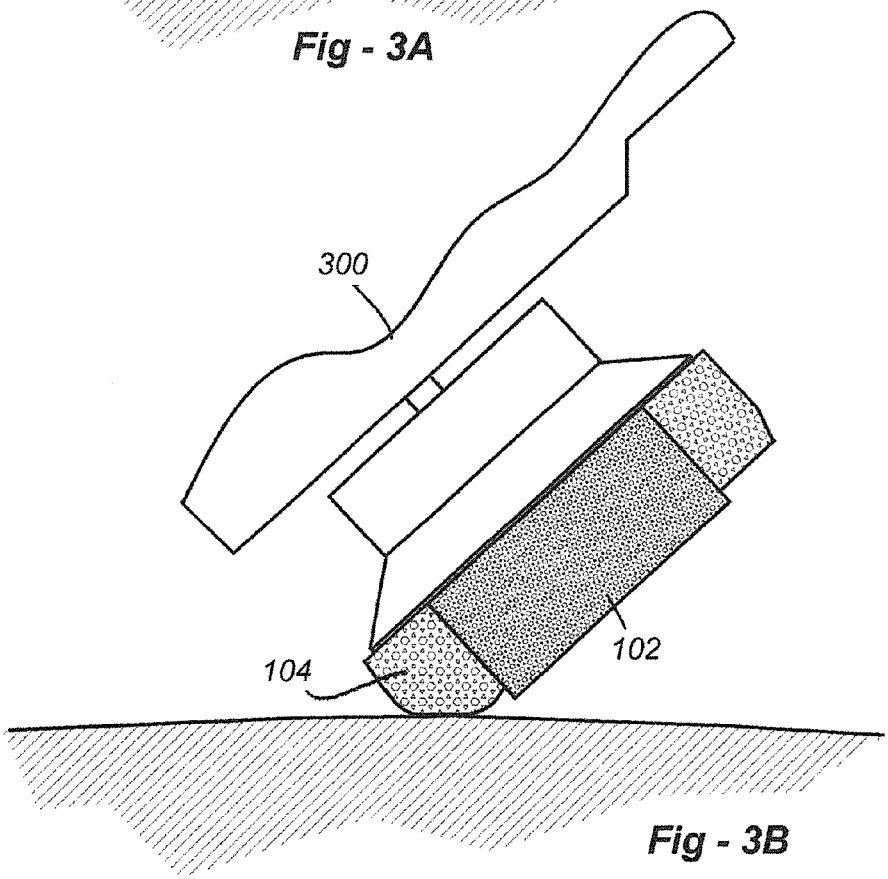
FIG. 3B shows the pad of FIGS. 1 and 2 mounted on an electric tool with the peripheral portion of the pad being used for a more refined surface treatment.

FIG. 3A shows the pad of FIGS. 1 and 2 mounted on an electric tool with the inner portion 102 of the pad being used for initial or rough surface treatment. The surface of the outer portion may be spaced-apart or touching the surface 302; it really does not matter because the outer portion 104 is softer and less abrasive. Following the initial buffing operation with the inner portion, the pad is turned on its side, as shown in FIG. 3B, enabling the outer pad portion to be used for a more refined surface treatment. Thus, in use, the stiffer center foam area 102 is used to remove larger scratches left from sand paper (or other abrasives), for example. In accordance with a method aspect of the invention, without removing the composite pad, the polisher tool 300 is tilted relative to the surface enabling the outer, softer foam area 104 to buff the area and remove any swirl marks.

The inner pad and outer pad are both preferably circular in shape and concentric. While typically attached to the polisher tool through a hook-and-loop back side, other attachment mechanisms may be used such as a threaded socket or peripheral elastic gathering. While different polishing compounds may be applied to the two different pad portions prior to use, one advantage of the invention is that a single liquid may be used with the different properties of the two pads being used for polishing and buffing without having to stop to change pads.

Figure 8:
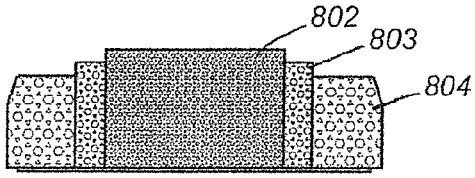
FIG. 8 shows the use of three concentric sections with gradually increasing stiffness toward the center of the pad.
Figure 9:
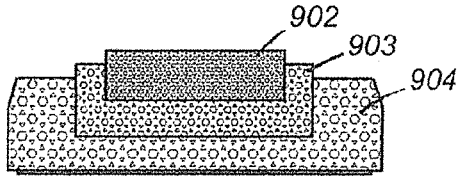
FIG. 9 shows a pad according to the invention with three different foams nested within one another.
Figure 10:
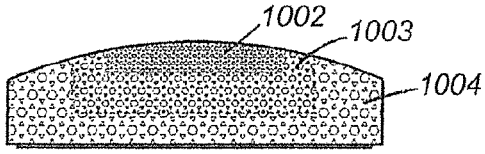
FIG. 10 illustrates an alternative embodiment of the invention where the transitions in foam stiffness or density are gradual as opposed to abrupt.
Figure 11:
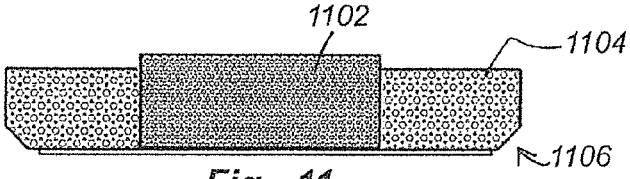
FIG. 11 is a drawing that shows a larger-diameter pad according to the invention including an outer chamfer on the bottom of the peripheral portion of the pad.

FIG. 8 shows the use of three concentric sections 802, 803, 804 with gradually increasing stiffness toward the center of the pad. FIG. 9 shows a pad according to the invention with three different foam pad portions 902, 903, 904 nested within one another. FIG. 10 illustrates an alternative embodiment of the invention where the transitions in stiffness or density are gradual as opposed to abrupt. This could be done by applying or injecting hardening gels or polymers into the inner portions of a relatively soft starting foam pad. FIG. 11 is a drawing that shows a larger-diameter pad 1104 according to the invention including an outer chamfer 1106 on the bottom of the peripheral portion of the pad. Again, a stiffer inner pad surface 1102 is provided.

I claim:

1. A composite pad useful in removing defects from painted surfaces, comprising:

a layer of backing material adapted for attachment to an orbital polisher or other tool;

an annular ring of material extending outwardly from the backing material and terminating in an annular abrasive outer surface;

an inner body of material permanently disposed at least partially within the annular ring, the inner body of material terminating in a concentric, circular abrasive outer surface that protrudes further outwardly than the annular abrasive outer surface; and wherein the annular outer surface is less abrasive than the concentric circular surface, enabling the concentric circular surface to be used for initial buffing or polishing operations without tilting the pad, and the annular abrasive outer surface to be used for finer buffing or polishing operations through tilting of the pad.

2. The composite pad of claim 1, wherein one or both of the annular ring of material and inner body of material are composed of foam.

3. The composite pad of claim 2, wherein the foam is a polyurethane foam.

4. The composite pad of claim 2, wherein the layer of backing material includes a hook-and-loop backside adapted for attachment to an orbital polisher or other tool.

5. The composite pad of claim 2, wherein:

both of the annular ring of material and the inner body of material are both composed of foam; and the density of the inner body of material is higher than the density of the annular ring of material.

6. The composite pad of claim 1, wherein the inner body of material is firmer or stiffer than the annular ring of material.

* * * * *